US006486609B1

(12) United States Patent
Shiratori et al.

(10) Patent No.: US 6,486,609 B1
(45) Date of Patent: Nov. 26, 2002

(54) ELECTRON-EMITTING ELEMENT AND IMAGE DISPLAY DEVICE USING THE SAME

(75) Inventors: Tetsuya Shiratori, Osaka (JP); Hideo Kurokawa, Katano (JP); Koji Akiyama, Neyagawa (JP)

(73) Assignee: Matsushita Electric Industries, Inc. (JP)

( * ) Notice: Subject to any disclaimer, the term of this patent is extended or adjusted under 35 U.S.C. 154(b) by 0 days.

(21) Appl. No.: 09/936,511

(22) PCT Filed: Mar. 16, 2000

(86) PCT No.: PCT/JP00/01620

§ 371 (c)(1),
(2), (4) Date: Sep. 14, 2001

(87) PCT Pub. No.: WO00/55880

PCT Pub. Date: Sep. 21, 2000

(30) Foreign Application Priority Data

Mar. 17, 1999 (JP) ..... 11-071467
Aug. 31, 1999 (JP) ..... 11-244716

(51) Int. Cl.[7] ..... H01J 3/02
(52) U.S. Cl. ..... 315/169.3; 313/309; 313/351

(58) Field of Search ..... 315/169.3; 313/495, 313/309, 351

(56) References Cited

U.S. PATENT DOCUMENTS 5,543,691 A * 8/1996 Palevsky et al. ..... 313/309

* cited by examiner

*Primary Examiner*—David Vu
(74) *Attorney, Agent, or Firm*—Parkhurst & Wendel, L.L.P.

(57) ABSTRACT

An electron-emitting element is provided which lessens the necessary voltage to be applied to a grid electrode and accurately and precisely controls electron emission from a cathode electrode. This is achieved by a field emission type electron-emitting element wherein an electric field existing between the grid electrode (3) and an anode electrode emanates from an electron passage opening in the grid electrode (3) to the cathode electrode (2) side and interacts with an electric field existing between the cathode electrode (2) and the grid electrode (3) such that a combined electric field is formed, and an electron-emission controlling element is provided which varies the intensity of the combined electric field by varying the potential of at least one of the cathode electrode (2), the anode electrode, and the grid electrode (3).

37 Claims, 8 Drawing Sheets

ELECTRON-EMITTING ELEMENT AND IMAGE DISPLAY DEVICE USING THE SAME

TECHNICAL FIELD

The present invention relates to a cold-cathode type electron-emitting element that brings about the field emission of electrons and to an image display device constructed using the same.

BACKGROUND ART

In recent years, accompanying increasing demands for a reduction in the thickness of displays and improved compactness, the development of microminiature electron-emitting elements capable of high-speed operation has become very active.

In the development of electron-emitting elements, research and development was first focused on the thermal emission type, but in recent years, research and development of the cold cathode type, which without requiring heating at high temperatures, can emit electrons even at a low voltage, has become extensive. Against this background and building on prior art, a cold-cathode type element structure capable of obtaining a stable, high current at low voltage and low power consumption and bringing about the emission of electrons from a selected location was proposed in the Japanese Unexamined Patent Publication No. H10-199398.

This element, as is shown in FIG. 8(*a*), takes on a structure such that a graphite layer 212, serving as the cathode electrode, is deposited in a line formation on a substrate 211, and on top of this, an electron-emitting layer 213 comprising a carbon nanotube layer is provided. In addition, an insulating region 214 is provided on both sides of the electron-emitting layer 213, and on top of this, a grid electrode 215 with a line formation is disposed so that it is orthogonal to the electron-emitting layer 213.

With this kind of structure, when a positive voltage is applied to the grid electrode 215 and a negative voltage to the cathode electrode 212, an electric field is generated at the sections where the electrodes intersect, and electrons are pulled from the intersecting sections of the cathode electrode. Therefore, by selecting a line to which to apply a voltage, it is possible to bring about the emission of electrons from a selected location. In addition, because the electron-emitting layer is made of carbon nanotubes, which have excellent discharge characteristics, a stable, large current can be obtained in a low vacuum and at a low voltage.

However, with this element structure, there are the following inherent problems:

1) Because the restricting of the pulling of electrons is accomplished only by the potential difference between the cathode and the grid, in order to pull electrons from the cathode, sufficient voltage must be applied to the grid electrode. Thus, it is difficult to realize a sufficiently low operation voltage.

2) Because an electric field is generated between the opposing surfaces of the intersecting cathode electrode and the grid electrode, many electrons emitted from the cathode electrode surface end up flowing into the grid electrode, which is the opposing surface. Therefore, the number of electrons that arrive at the anode, which is disposed above the grid electrode, is not more than the small portion that passes through the central portion of the electron passage hole. Thus, the usage efficiency of the emitted electrons is low.

3) The anode electrode is disposed above the grid electrode, but when a potential is supplied to the anode electrode, an electric field concentration arises at the edge portions of the grid electrode, and thus the generating of abnormal discharge from the edge portions of the grid 215 tends to occur. Abnormal discharge causes a considerable deterioration in the reliability of the electron-emitting device.

DISCLOSURE OF THE INVENTION

The present invention was developed to solve the foregoing and other problems. The inventors of the present invention, through intense research, discovered that electrons could be very efficiently pulled from an electron-emitting material (the cathode electrode) by combining an electric field between the anode electrode and the cathode electrode and an electric field between the grid electrode and the cathode electrode and that abnormal discharge from the edge portions of the grid electrode could be prevented by adjusting the placement and shape of the grid electrode. The inventors thus achieved the present invention. The present invention has the following construction.

(1) An electron-emitting element is provided comprising an electron conveying member, a cathode electrode comprising an electron-emitting member fixed to the electron conveying member, an anode electrode disposed such that it is spaced from the cathode electrode, and a grid electrode disposed between the cathode electrode and the anode electrode and having an electron passage opening, wherein the spatial positioning of the three members, the cathode electrode, the anode electrode and the grid electrode, and their respective shapes are constructed such that an electric field existing between the grid electrode and the anode electrode emanates from the electron passage opening to the cathode electrode side, and the emanated electric field and an electric field existing between the cathode electrode and the grid electrode interact with each other to form a combined electric field, and electron-emission controlling means is provided for varying the intensity of the combined electric field by varying the potential of at least one of the cathode electrode, the anode electrode, and the grid electrode to control the number of electrons emitted from the cathode electrode.

This construction is characterized in that a combined electric field is formed from the electric field that emanated to the cathode electrode side and the electric field generated between the cathode electrode and the grid electrode and the field emission of electrons from the cathode electrode is controlled by varying the intensity of the combined electric field. Compared with conventional field emission elements, an element employing this control method makes remarkably efficient field emission possible. Thus, at a low operating voltage, there is good response and stable electron emission can be brought about. The basic principle of this kind of electron-emitting element of the present invention is described with reference to FIG. 1.

In an electron-emitting element of the present invention, in order to form a combined electric field, the spatial positioning and shapes of the three members, the cathode electrode, the anode electrode, and the grid electric, are appropriately adjusted, and by utilizing the electron-emission controlling means, the intensity of the combined electric field is controlled to control the number of electrons emitted from the cathode electrode. The characteristics and technical significance of this combined electric field is made clear by FIG. 1.

FIG. 1 shows the concept that supposing a voltage much lower than but with the same polarity as that of the anode electrode is applied to the grid electrode, the state of the combined electric field is as represented by equipotential surfaces 10. As is shown in FIG. 1, an electric field existing between a grid electrode 3 and the anode electrode emanates from the electron passage opening of the grid electrode 3 to the cathode electrode side and this emanated electric field interacts with an electric field generated between a cathode electrode 2 and the grid electrode 3 to form a protruding set of equipotential surfaces on the cathode electrode side. This set of equipotential surfaces is the combined electric field.

A combined electric field region 11 of FIG. 1 designates the range of the effect of the emanating electric field, in other works the range of the combined electric field. The respective intervals of the group of equipotential surfaces within the combined electric field region 11 are, as shown in FIG. 1, the most narrow on the line (valley line) connecting the points (valleys) of each equipotential surface, and as the distance from the valley line increases to either the right or the left, the equipotential surface intervals widen. In other words, the group of points on the valley line have the largest potential differences, and as the distance from the valley line increases to either the right or the left, the potential differences decrease. In addition, this valley line is orthogonal to an anode electrode surface and the cathode electrode. This aspect of the combined electric field gives rise to the following positive effects at the time of electron emission.

First, because the valley line shows potential differences larger than other regions, in the valley line portion where the valley line intersects with the cathode electrode, the effect on the pulling of electrons from the cathode electrode increases. The pulled electrons are then guided along the valley line, which shows the largest potential differences, and arrive at the anode electrode. Thus, there is little decline in electron usage efficiency due to the absorbing of electrons by the grid electrode. In other words, according to the method of the present invention, which employs a combined electric field, the valley line consistently guides electrons emitted from the cathode electrode to the anode electrode, having the function of a tunnel for flying electrons as it were. Thus, by even lower grid electrode voltages, it is possible to make electrons pulled from the cathode electrode efficiently arrive at the anode electrode.

It was confirmed through experiment that when a combined electric field is employed, the effects and the like on the pulling of electrons from the cathode electrode are remarkably increased, but the relationship between the individual electric fields and the combined electric field, the state of the distribution of electric potential within the combined electric field, and the like are not at the present fully understood. It is to be noted that potential differences in conventional elements that do not employ a combined electric field are such that equipotential surface intervals are as shown on the outside of the combined electric field region 11 in FIG. 1.

As described above, according to the above-described construction of the present invention, the potential applied to the anode electrode and the grid electrode can be very effectively utilized for the pulling of electrons from the cathode electrode, and thus compared with field emission type elements having conventional constructions, an even greater number of electrons can be consistently pulled from the cathode electrode with even less power.

(2) The present invention may further take on the following construction.

The work function of at least an anode electrode side surface of the grid electrode may be larger than the work function of the cathode electrode. This construction makes it possible to prevent the abnormal discharge of electrons from a surface of the grid electrode in the direction of the anode electrode.

The grid electrode may be earthed by means of an electric circuit through which electrons do not flow from the earthed side. This construction makes it possible to prevent abnormal discharge from the grid electrode.

The grid electrode may be disposed between the cathode electrode and the anode electrode so that at least the relationship $d \geqq Z1$ is satisfied, where d is the maximum opening length of the electron passage opening and Z1 is the vertical distance from a cathode electrode surface to a surface on the cathode electrode side of the grid electrode. This construction makes it possible for the electric field between the anode electrode and the grid electrode to easily spread from the electron passage opening of the grid electrode.

An electric field concentration reducing means for reducing an electric field concentration from the anode electrode may be performed in the vicinity of the electron passage opening of the grid electrode, and the electric field concentration reducing means may be such that the work function of a perimeter edge portion on the anode electrode side of the electron passage opening of the grid electrode is larger than the work function of other portions of the grid electrode. In addition, it may be such that at least the perimeter edge portion on the anode electrode side of the electron passage opening of the grid electrode is chamfered. By employing this construction, abnormal discharge from the vicinity of the electron passage opening is prevented.

The electron-emission controlling means in the construction of the present invention may be such that the potential of the anode electrode with respect to the cathode electrode is constant and the strength of the combined electric field is varied by varying the potential of the grid electrode. The present invention employs a construction such that the electric field on the anode electrode side is emanated from the opening of the grid electrode to the cathode electrode side and is combined with the electric field generated between the grid electrode and the cathode electrode. This construction makes it possible to vary the characteristics and intensity of a combined electric field by varying only the potential of the grid electrode, thus making it possible to vary the number of electrons emitted from the cathode electrode. As a result, by appropriately adjusting the potential of the anode electrode, the grid electrode potential, serving as the potential for controlling the number of electrons emitted from the cathode electrode, can be made very small.

The electron-emission controlling means may be such that the potential of the anode electrode with respect to the cathode electrode is a potential at which the field emission of electrons from the cathode electrode in the direction of the anode electrode cannot be brought about by only the potential thereof, the potential of the grid electrode has the same polarity as that of the anode electrode, and by varying the potential of the grid electrode, the strength of the combined electric field is varied.

Even if the potential of the anode electrode with respect to the cathode electrode is a potential at which the field emission of electrons from the cathode electrode in the direction of the anode electrode cannot be brought about by only the potential thereof, by appropriately arranging and so forth the spatial positioning and the respective shapes of the three members, the cathode electrode, the anode electrode, and the grid electrode, an electric field is emanated from the electron passage opening of the grid electrode and this emanating electrode acts on the electric field between the grid electrode and the anode electrode making it possible to form a combined electric field. The intensity and the like of this combined electric field can be varied by varying the grid electrode potential by utilizing the electron-emission controlling means. This makes it possible to easily control electron emission from the cathode electrode.

The electron-emission controlling means may be such that the potential of the anode electrode with respect to the cathode electrode is a potential at which the field emission of electrons from the cathode electrode in the direction of the anode electrode can be brought about by only the potential thereof, and by varying the potential of the grid electrode, the strength of the combined electric field is varied. With this construction, the emission of electrons from the cathode electrode can be controlled as in the above construction, but in this construction, the potential applied to the grid electrode may be varied within the range of plus to 0 to minus to control field emission. Specifically, when restricting the emitting of electrons from the cathode electrode, a potential having a reverse polarity to that of the anode electrode is applied to the grid electrode, and when a further increase in the number of electrons pulled from the cathode electrode is desired, a potential having the same polarity as that of the anode electrode is applied.

The cathode electrode of a construction of the present invention may comprise an electron-emitting member formed into a columnar shape, and the electron-emitting member may be disposed so that an extension line in the tip direction of the electron-emitting member passes through the electron passage opening and is orthogonal to an anode electrode surface. According to the present invention, as is shown in the FIG. 1, the valley line, which shows large potential differences, is formed perpendicularly to the anode electrode. Consequently, by making the electron-emitting member into a columnar shape and by disposing this member preferably so that it coincides with the valley line, an electric field concentration is generated in the tip portion of the columnar electron-emitting member, and thus electron emission from the member is simplified and because the equipotential surface density on the side surfaces of the column is high, efficient discharge is made possible. In other words, because the zone of large potential differences can be effectively utilized, this construction makes high current discharge at a low operating voltage possible. It is to be noted, based on the conceived form of the combined electric field in FIG. 1, that discharge efficiency improves when disposing a columnar electron-emitting member along the valley line within the combined electric field region more than when using a planar electron-emitting member.

The electron-emitting member may have a shape such that the relationship $r \leqq 0.3D$ is satisfied, where r is the radius of curvature of a tip corner portion and D is the maximum width of the column. It is preferable that this shape be employed because, when employing this shape, an electric field concentration arises in the tip of the electron-emitting member.

The grid electrode and the cathode electrode may be constructed such that the relationship $d \geqq Z1$ is satisfied, where d is the maximum opening length of the electron passage opening of the grid electrode and Z1 is the vertical distance from a tip of the electron emitting member. It is preferable that $d \geqq Z1$ because the spreading of the anode potential gets larger when $d \geqq Z1$.

The grid electrode and the cathode electrode may be constructed such that the relationship $Z1 \leqq 0.25L$ is satisfied, where L is the height of the electron-emitting member from a surface of the electron conveying member and Z1 is the vertical distance from a tip of the electron-emitting member to a surface of the grid electrode. This condition makes it possible to further effectively utilize the spreading of the anode potential and to enhance the electric field concentration directed at the electron-emitting member.

The electron-emitting element may be constructed such that the electron-emitting member has a shape such that the relationship $r \leqq 0.3D$ is satisfied, where r is the radius of curvature of a tip corner portion thereof and D is the maximum width of the column, the grid electrode is disposed such that the relationship $Z1 \leqq 0.25L$ is satisfied, where L is the height of the electron-emitting member from a surface of the electron conveying member and Z1 is the vertical distance from a tip portion of the columnar electron-emitting member to a surface of the grid electrode, and the size of the electron passage opening is fixed so that the relationship $d \geqq Z1$ is satisfied, where d is the maximum opening length of the electron passage opening of the grid electrode. This construction makes it possible, because the combined electric field can be very effectively utilized, to realize an electron-emitting element which can obtain a high current discharge at a low operating voltage.

The electron-emitting member may comprise a carbon-type material.

The electron-emitting member may comprise graphite having six-carbon rings with dangling σ bonds. Graphite having six-carbon rings with dangling σ bonds shows directivity in electron emission and thus is favorable as the electron-emitting member.

The electron-emitting member may comprise a crystal whisker substance. This is preferable because a crystal whisker substance is excellent for electron emission.

The electron-emitting member may comprise carbon fiber. Carbon fiber is preferable from the perspective of excellent discharge characteristics and a moderate price.

The electron-emitting member may comprise carbon nanotubes. Carbon nanotubes are preferable because the tips are rounded and it is excellent in terms of electron emission.

The cathode electrode may further comprise at least one other electron-emitting member fixed to a surface of the electron conveying member, the electron-emitting members having a columnar shape, the electron-emitting element may be constructed such that, between the electron-emitting members and the grid electrode, the relationships $P \geqq 0.5L$ and $Z1 \leqq 0.25L$ are satisfied, where P is the interval between each of the electron-emitting members and Z1 is the vertical distance from a tip of the electron-emitting member having the highest vertical height to a surface of the grid electrode. Using a cathode electrode having a plurality of electron-emitting members makes it possible to increase the number of electrons emitted more than is possible with a cathode having a single electron-emitting member under the same operating voltage. However, when the placement interval of the plurality of electron-emitting members is less than half of the length of the members, because the electric field concentration at each electron-emitting member weakens, the advantageous effects of providing a plurality of electron-emitting members is offset. For this reason, in order to sufficiently obtain the advantageous effects of providing a plurality of electron-emitting members, it is preferable to construct the cathode electrode such that $P \geqq 0.5L$ and $Z1 \leqq 0.25L$.

In the case of a plurality of electron-emitting members also, the work function of at least an anode electrode side surface of the grid electrode may be larger than the work function of the cathode electrode. By making the work function of the anode electrode side of the grid electrode larger, prevention of abnormal discharge from the grid electrode is made possible.

In the case of a plurality of electron-emitting members also, the maximum length d of the electron passage opening of the grid electrode may be formed such that the relationship $d \geqq Z1$ is satisfied, where d is the maximum opening length of the electron passage opening of the grid electrode and Z1 is the vertical distance from the tip of the electron-emitting member having a vertical height L to the surface of the grid electrode.

In the case of a plurality of electron-emitting members also, electric field concentration reducing means for reducing an electric field concentration from the anode electrode may be performed in the electron passage opening of the grid electrode.

In the case of a plurality of electron-emitting members also, the electric field concentration reducing means may be such that the work function of the perimeter edge portion of the electron passage opening of the grid electrode on the anode electrode side is larger than the work function of other portions of the grid electrode.

In the case of a plurality of electron-emitting members also, the electric field concentration reducing means may be such that chamfering is performed on at least the perimeter edge portion of the electron passage opening of the grid electrode on the anode electrode side.

In the case of a plurality of electron-emitting members also, the grid electrode may be earthed by means of an electric circuit through which electrons do not flow from the earthed side.

In the case of a plurality of electron-emitting members also, the electron-emitting members may comprise a carbon-type material.

In the case of a plurality of electron-emitting members also, the electron-emitting members may comprise graphite having six-carbon rings with dangling $\sigma$ bonds.

In the case of a plurality of electron-emitting members also, the electron-emitting members may comprise a crystal whisker substance.

In the case of a plurality of electron-emitting members also, the electron-emitting members may comprise carbon fiber.

In the case of a plurality of electron-emitting members also, the electron-emitting members may comprise carbon nanotubes.

(3) An image display device of the present invention may have the following construction. An image display device comprises a plurality of electron-emitting elements, a circuit which is connected to each of the electron-emitting elements and which transmits electric signals to each of the electron-emitting elements for electron emission, and an image formation section for forming an image by means of electrons emitted from the electron-emitting elements, wherein the electron-emitting elements are any of the electron-emitting elements of the previously described aspects of the invention.

This construction, because it exhibits the advantageous effects of operation of any of the previously described electron-emitting elements, makes it possible to realize an image display device which can achieve highly accurate images at a low operating voltage.

BRIEF DESCRIPTION OF THE DRAWINGS

FIG. 8A is a perspective view showing the overall structure and FIG. 8B is a partial cross sectional view.

BEST MODE FOR CARRYING OUT THE INVENTION

The present invention is described in detail with respect to the examples. In the figures employed herein, the same reference numbers are used to designate elements having the same function, and explanation in each example is omitted.

EXAMPLE 1

Figure 2:
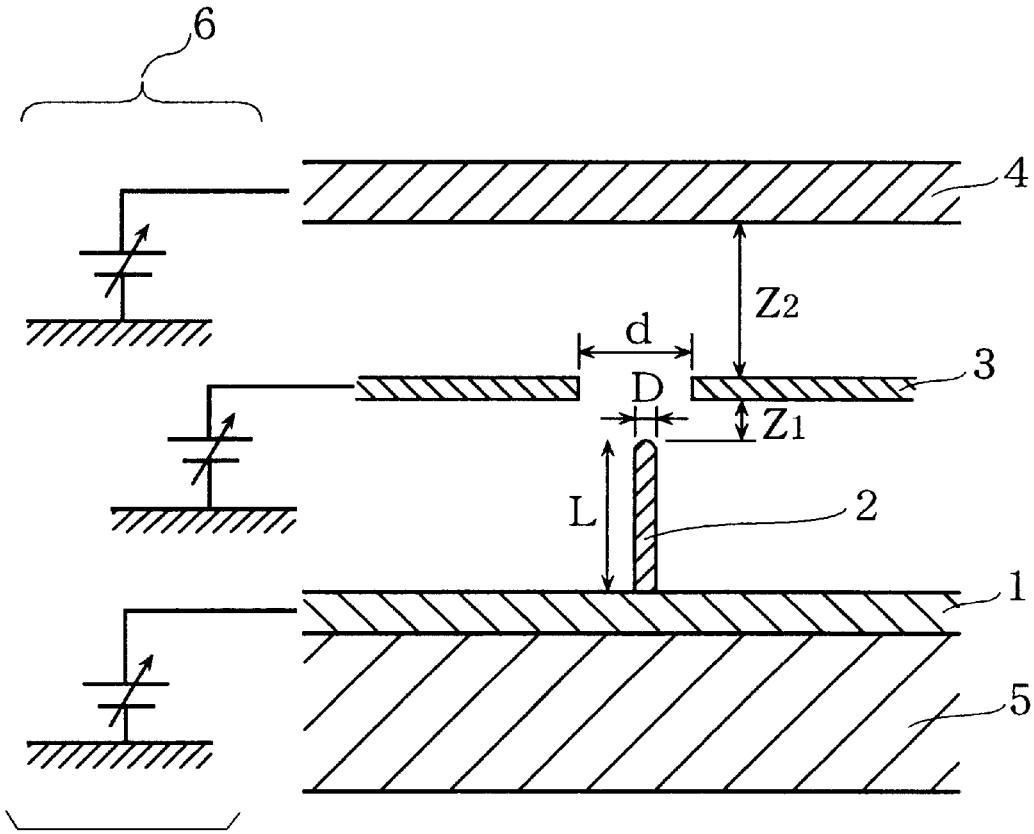
FIG. 2 is a cross sectional schematic view of an electron-emitting element in accordance with Example 1.

An electron-emitting element of Example 1 is described with reference to FIG. 2. FIG. 2 is a schematic cross sectional view of the element. In the figure, reference number 5 designates an insulative substrate comprising soda glass or the like. Reference number 1 designates an electron conveying member which comprises a conductive layer and is formed on the substrate 5. Reference number 2 designates a cathode electrode which comprises an electron-emitting member and is fixed on the electron conveying member 1. Reference number 3 designates a grid electrode disposed between the cathode electrode 2 and an anode electrode 4. Reference number 6 designates an electron-emission controlling section (an electron emission controlling means) for controlling the number of electrons emitted from the cathode electrode. The electron-emission controlling section 6 has an electric circuit which varies the voltage applied to each electrode according to external input signals and a program set up in advance. This circuit is constructed so that it can, not only change voltages of a certain polarity to voltages of the same polarity, but can vary voltage within a wide range, from negative voltages including those of reverse polarity to positive voltages.

The spatial locations and shapes of each of the above-mentioned members are described as follows.

The cathode electrode 2 is a columnar structure having a length (height) L and a maximum width D and a tip portion having a rounded shape. The rounded shape is constructed so that the relationship between the radius of curvature r of this rounded shape and the width D is such that the expression $r \leqq 0.3D$ is satisfied.

The grid electrode 3 has an electron passage opening with a diameter d and is disposed such that the opening is positioned over a line extended from the tip of the cathode electrode 2, and the vertical distance from the tip of the cathode electrode 2 to a surface of the grid electrode is Z1. In addition, the relationship between diameter d of the opening and the vertical distance Z1 is adjusted in advance so that the expression $d \geqq Z1$ is satisfied, and the relationship between the length L of the cathode electrode 2 and Z1 is adjusted in advance of that the expression $Z1 \leqq 0.25L$ is satisfied.

The anode electrode 4 is disposed at a location defined by the vertical distance Z2 from the upper surface of the grid electrode 3.

The electron-emitting element of Example 1 will now be described in detail. The electron conveying member 1 is a conductive layer which conveys and supplies electrons to the cathode electrode 2 and is made of a thin or thick film comprising a metal or the like. The structure may be single layer or multilayer, but in this example, the structure is composed of a single layer aluminum film.

For the cathode electrode 2, a variety of materials having electron emission capability may be used. Examples of this kind of material include carbon fiber, graphite, carbon nanotube, and diamond. As for the shape of the cathode electrode 2, it may be two-dimensional, but from the perspective of electron emission efficiency, it is preferable that it be columnar (prismatic, cylindrical, or acicular) and that the tip portion be rounded. In addition, when the shape of the cathode electrode (electron-emitting member) is made columnar, it is preferable to dispose the electrode so that the line containing the central axis of the cathode electrode is orthogonal to the anode electrode, and it is even more preferable that the above-mentioned central axis line corresponds to the valley line in FIG. 1. When the cathode electrode is disposed in this manner, as is explained in the summary, electric field concentration arises at the tip portion of the cathode electrode, and thus electrons can be easily pulled from the cathode electrode and guided along the valley line to the anode electrode without flowing into the grid electrode along the way. Consequently, the usage efficiency of electrons remarkably increases.

In this example, a columnar cathode electrode formed by bonding like carbon nanotubes together to form a rod so that L=2 mm and D=0.2 mm and by forming the tip of the electrode into a rounded shape having a radius of curvature of approximately r=0.04 mm is used. In addition, for the grid electrode 3, a SUS plate (Ni—Cr copper plate) having a plate thickness of 0.1 mm and an electron passage opening (hole) with a diameter of 3 mm formed therein is used. This grid electrode 3 is disposed in the location defined by Z1=0.5 mm ($Z1 \leqq 0.25L$) from the tip of the cathode electrode 2.

In addition, the anode electrode 4 is composed of a transparent conductive material made of, for example, ITO (indium tin oxide), and a layer of, for example, fast P22 phosphors is formed on a surface of the transparent conductive material. This is so that light is emitted when electrons are obtained from the cathode electrode. Also, the distance Z2 of the anode electrode 4 in this example from the grid electrode 3 is 1 mm. The above-mentioned fast phosphors are convenient for pulling in electrons at a high voltage of 6 to 10 kV and emitting light.

The method of adhering the electron conveying member 1 to the electron-emitting member (cathode electrode 2) is not particularly limited, but it is preferable to, for example, carry out the process in a vacuum using a vehicle that has a record of being widely used. In addition, it is possible to form the electron-emitting member directly on the electron conveying member 1 using, for example, printing, photomasking, or etching. An example for the above-mentioned vehicle is a mixed substance comprising 99% isoamyl acetate and 1% nitrocellulose.

Next, an electron-emitting element prepared in this manner was operated and performance was evaluated. Specifically, for a potential just under the potential necessary for bringing about the unassisted field emission of electrons from the cathode electrode, a voltage of 8 kV (constant) was applied to the anode electrode 4 of an element prepared as described above. Under these conditions, the voltage of the grid electrode was varied in the range of 0 V to approximately 100 V As a result, when a positive voltage of 40 V was applied to the grid electrode 3, the emission current of the cathode electrode was 1 $\mu$A.

On the other hand, under the condition that voltage was applied only to the grid electrode 3, without applying voltage to the anode electrode 4, in other words, under the condition that there was absolutely no spreading of an electric field from the anode electrode, when the voltage applied to the grid electrode 3 was varied, it was necessary to apply a voltage of 600 V in order to bring about the field emission of electrons from the cathode electrode.

From comparing the results of the above experiments, it was confirmed that the electron-emitting element of Example 1 could be operated at a lower voltage than is necessary with the conventional method that doesn't make use of a combined electric field.

Figure 1:
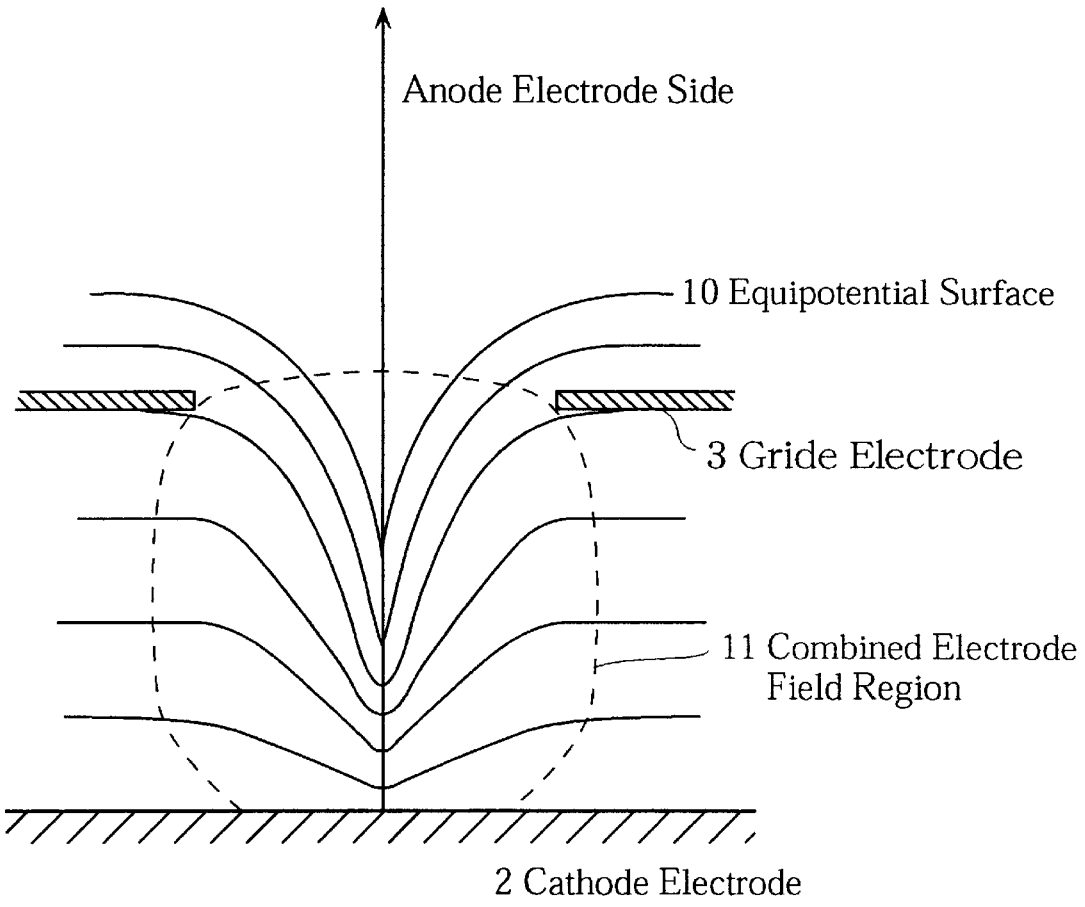
FIG. 1 is a schematic view illustrating the principles of the present invention.

However, as in the above-described example of operation, when a potential is supplied just under the potential necessary for bringing about the unassisted field emission of electrodes from the cathode electrode and under this condition, the voltage of the grid electrode 3 is varied, it is possible to easily vary the number of electrons emitted from the cathode electrode 1 at a low voltage. The reason for this is thought to be that in pulling electrons from the cathode electrode 2, it is necessary to impose, on the cathode electrode (the electron-emitting member), an electric field above the threshold for field emission, but in an element of the above construction, the electric field generated by the electrode applied to the anode electrode 4 emanates from the electron passage opening to the cathode electrode side. This emanated electric field combines with the electric field generated by the applying of voltage to the grid electrode to form a combined electric field. This combined electric field, as is shown in FIG. 1, is such that equipotential surfaces have a dense valley line. Because this valley contributes to the pulling of electrons from the surface of the cathode electrode, it is possible to very efficiently pull electrons from the surface of the cathode electrode with a small grid electrode potential. In addition, electrons can very efficiently reach the anode electrode.

As was explained above, the electron-emitting element of Example 1 is constructed such that by applying a voltage to both the anode electrode and the grid electrode, a combined electric field is formed, and the distribution and intensity of this combined electric field can be controlled by the electron-emission controlling means 6. With an element having this kind of construction, excellent electron-emitting characteristics not attainable in the past can be obtained.

EXAMPLE 2

Figure 3:
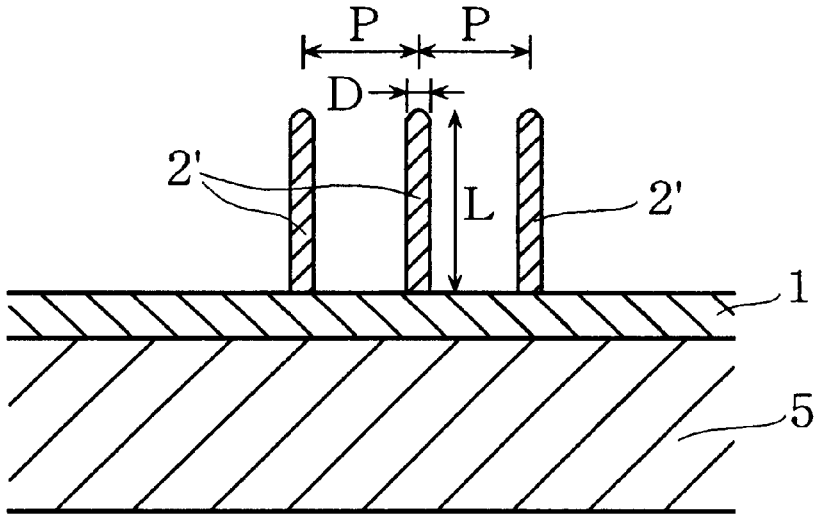
FIG. 3 is a cross sectional schematic view of the cathode electrode section of an electron-emitting element in accordance with Example 2.

In Example 2, the cathode electrode 2 was constructed using a plurality of columnar electron-emitting members. Specifically, as is shown in FIG. 3, the distance between the central axes of each respective column of the electron-emitting members having a maximum width D was made P, and the plurality of electron-emitting members 2' were fixed to the electron conveying member 1 to form the cathode electrode 2. More specifically, 5 cylindrical electron-emitting members comprising carbon nanotubes and having a maximum width D=0.2 mm, a length L=2 mm, and a tip having a radius of curvature r=0.04 mm were prepared, the distance between the central axes of each electron-emitting member was made P=1 mm, and the electron-emitting members were fixed side by side on the electron conveying member 1. Using a cathode electrode 2 prepared in this manner and otherwise following the same conditions as those of Example 1, an electron-emitting member in accordance with Example 2 was thus prepared.

It is preferable, from the standpoint of keeping mutual interference between adjacent electron-emitting members to a minimum and effectively concentrating an electric field at each respective electron-emitting member, that the distance P be set so as to satisfy the expression $P \geqq 0.5L$. The distance P was set in this manner because it was experimentally confirmed that field emission effectively progressed when this condition was satisfied as compared to when this condition was not satisfied.

It was confirmed that when the same conditions as those of Example 1, namely when the voltage applied to the anode electrode was 8 kV (constant) and voltage was applied to the grid electrode, were applied to an electron-emitting element in accordance with Example 2 constructed such that the expression $P \geqq 0.5L$ is satisfied, a discharge current 3 times that of the element of Example 1 was obtained for the same grid electrode voltages. In addition, the acceptable range of positioning (the positioning of the tips of the electron-emitting members and the electron passage opening of the grid electrode) accuracy in the assembly of an element was greater with a cathode electrode having a plurality of columnar electron-emitting members as compared with a cathode electrode having 1 electron-emitting member, and thus in this aspect, manufacturing operation is facilitated.

EXAMPLE 3

An electron-emitting element of Example 3 differs from an element of Example 1 in that it has a construction such that a potential capable of bringing about the field emission of electrons from the cathode electrode by only the potential of the anode electrode 4 is supplied to the anode electrode 4. In other respects, the element is like that of Example 1. This construction is realized by applying a prescribed voltage to the anode electrode 4 by utilizing the electron-emission controlling means 6. When a potential which can bring about the field emission of electrons from the cathode electrode by only the potential of the anode electrode 4 is supplied to the anode electrode 4, electrons are emitted from the cathode electrode 2 in the direction of the anode electrode 4 even if voltage is not also applied to the grid electrode 3. Therefore, in restricting the number of electrons emitted, a potential having a polarity differing from that of the anode electrode (negative potential) is supplied to the grid electrode 3. On the other hand, when it is desirable to further increase the number of electrons emitted from the cathode electrode, a potential having the same polarity as that of the anode electrode (positive potential) is applied to the grid electrode 3. Accordingly, with an element of this construction, it is possible to greatly vary the number of electrons emitted from the cathode electrode by altering the variety of potential applied to the grid electrode 3 and the size of the potential. In other words, with this construction, an electron-emitting element having very good applicability can be realized.

In addition, because the reverse polarity potential (negative) supplied by the grid electrode is imposed such that the electron beam is converged in the electron passage opening of the grid electrode, according to this construction, it is possible to effectively ensure the arrival of the emitted electrons at the anode electrode.

Next, the element of Example 3 was operated and performance was evaluated. Namely, 10 kV, a potential slightly greater than the potential required to bring about the field emission of electrons from the cathode electron 2 by only this voltage, was applied to the anode electrode 4, and the potential of the grid electrode 3 was varied. As a result, when a negative voltage of 50 V was applied to the grid electrode 3, it was confirmed that 1 $\mu$A of current was emitted from the cathode electrode 2. On the other hand, when the voltage to the anode electrode was made 0 V, it was found that the voltage to the grid electrode necessary to pull electrons from the cathode electrode was 600 V.

By a comparison of the results of these experiments, the capability of restricting the pulling of electrons with an extremely small operating voltage was demonstrated by employing of the element construction of Example 3.

EXAMPLE 4

In Example 4, an electron-emitting element was prepared having the same structure as that of Example 1 except that chamfering was performed on the perimeter of an electron passage opening 3*a* of the grid electrode 3.

Figure 4:
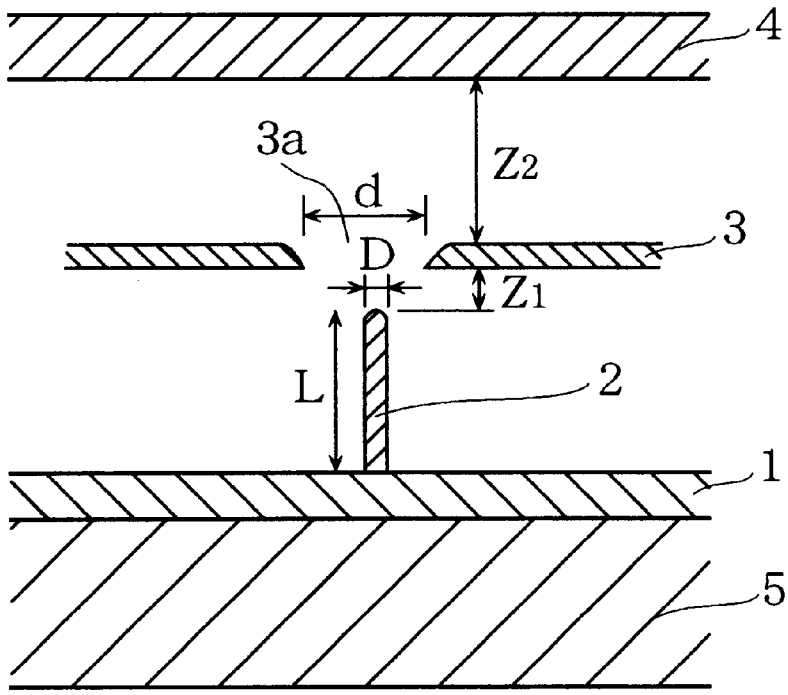
FIG. 4 is a cross sectional schematic view of an electron-emitting element in accordance with Example 4.

A schematic cross sectional view of this element is shown in FIG. 4. The chamfering consists of making edges sloped or round. When this kind of chamfering is performed on a perimeter edge of the electron passage opening 3*a*, electric field concentration at the perimeter edge is reduced. Thus, abnormal discharge from the edges of the opening is suppressed, and because electric field concentration arises at the tip of the cathode electrode 2 having overcome the edges of the opening, discharge from the cathode electrode 2 proceeds smoothly.

The method of chamfering is not particularly limited, but in the case of sloping edges, it is effective to perform the chamfering on the edge that is on the side of the anode electrode because abnormal discharge tends to occur on this side. An example of a method of chamfering includes etching the opening portion of the grid electrode with an etching liquid.

The electron-emitting element of Example 4 was operated under the same conditions as that of Example 1, namely a potential (8 KV) at which the unassisted pulling of electrodes from the cathode electrode 2 is not possible was supplied, and under the condition that a variety of positive voltages were applied to the grid electrode 2, and performance was evaluated. As a result, when a voltage of 40 V was applied to the grid electrode 2, the generating of a discharge current of 1 $\mu$A by the cathode electrode with absolutely no occurrence of abnormal discharge from the electron passage opening 3*a* was confirmed.

However, while in Example 4 chamfering was performed as a means for reducing electric field concentration, abnormal discharge at the edges of the opening due to electric field concentration can be prevented by making the work function of the perimeter of the opening greater than that of other portions. The greater the work function, the more difficult is discharge. As a method of partially changing work functions, it is possible to, for example, attach (including application) a member having a large work function in the vicinity of the electron passage opening 3*a*. In addition, a member having a large work function may be attached to the chamfered surface.

EXAMPLE 5

An electron-emitting element was constructed such that the structure was the same as that of Example 4, a potential capable of bringing about the unassisted field emission of electrons from the cathode electrode was applied to the anode electrode, and an electron-emission controlling means which can vary the voltage applied to the grid electrode 3 was provided. The element was operated and performance was evaluated.

Specifically, a voltage of 10 KV, a voltage slightly larger than the voltage by which electrons are emitted from the cathode electrode without assistance, was applied to the anode electrode, and the voltage applied to the grid electrode was varied. As a result, when a negative voltage (reverse polarity to the anode) of 50 V was applied to the grid electrode 3, a discharge current of 1 $\mu$A by the cathode electrode 2 was confirmed. In addition, even when the voltage of the grid electrode was varied in the range from negative to positive, there was absolutely no occurrence of abnormal discharge from the electron passage opening 3*a*.

EXAMPLE 6

An electron-emitting element of Example 6 essentially has the same structure as that of Example 1, but differs in that the work functions of the cathode electrode and the grid electrode are regulated. Namely, the element was constructed such that a material having a larger work function than that of the electron-emitting member making up the cathode electrode 2 was used as the material for the grid electrode 3. Specifically, while the cathode electrode 2 was composed of carbon nanotubes, the grid electrode 3 was composed of a nickel plate.

Under the condition that the work function of the grid electrode 3 be larger than that of the cathode electrode, it is not necessarily necessary to satisfy the condition with a single material. For example, if the cathode electrode is composed of a carbon-type electron-emitting member such as carbon nanotubes, the grid electrode may be such that an aluminum oxide film with a thickness of 5000 Å is formed on a SUS plate (Ni—Cr copper plate) having a plate thickness of 0.1 mm and an electron passage opening formed therein. Then, the aluminum oxide film surface of this grid electrode is disposed such that it is opposed to the anode electrode and is taken to be the grid electrode 3. In this way, it is possible to satisfy the above-described condition. It is preferable that an aluminum oxide film not be formed on the inside perimeter surface of the grid electrode 3. Because aluminum oxide is a dielectric substance, when aluminum oxide is present in the vicinity of the electron orbits, namely when on the inner side surface of the electron passage opening, there are cases of interruption in the flow of electricity because of deterioration in electron pulling capability.

On the other hand, opposite to that described above, it is possible to form an aluminum film with a thickness of 5000 Å on one side only of an aluminum oxide plate having a plate thickness of 0.5 mm and an electron passage opening formed therein, and to dispose the aluminum film side on the cathode electrode side to form the grid electrode 3. In this case, it is preferable to form an aluminum film on the inside perimeter surface of the electron passage opening 3*a*. However, from the standpoint of preventing abnormal discharge, it is preferable that the aluminum film be formed up to a position slightly below the upper edge surface of the anode electrode side of the aluminum oxide plate.

In the element of Example 6 prepared in this manner, because at least the anode electrode side surface of the grid electrode 3 has a work function larger than that of the cathode electrode, electron tunneling resulting from electric field concentration is easily brought about at the cathode electrode 2 (the electron-emitting member). Namely, as was confirmed by operation experiments, it is difficult for abnormal discharge to occur.

EXAMPLE 7

An electron-emitting element of Example 7 is characterized in that an electric circuit is built in such that electrons do not flow to the grid electrode 3 from the earthed side. Other constructions are the same as those of Example 1.

Figure 5:
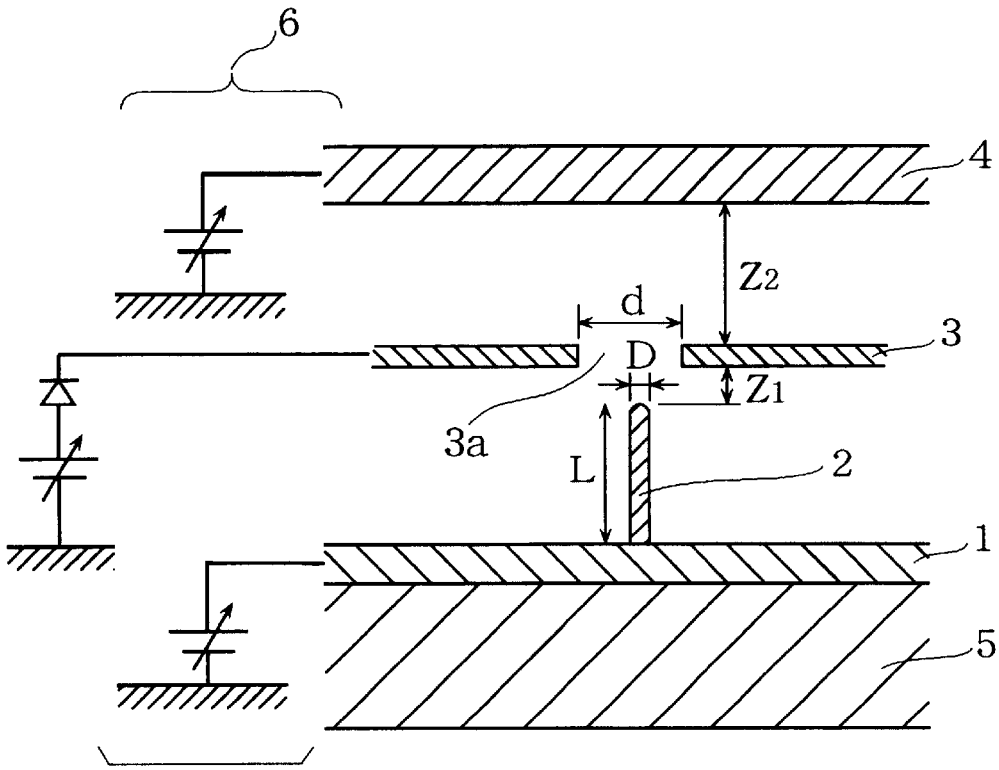
FIG. 5 is a cross sectional schematic view of an electron-emitting element in accordance with Example 7.

A schematic cross sectional view of the element of Example 7 is shown in FIG. 5. As is shown in the figure, an electric circuit comprising a diode and the like is built in such that electrons do not flow to the grid electrode 3 from the earthed side.

Figure 6A:
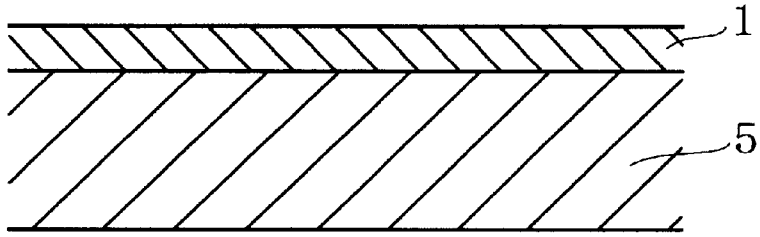
FIGS. 6A–6C are cross sectional schematic views illustrating the production process of an electron-emitting element in accordance with Example 7.
Figure 6B:
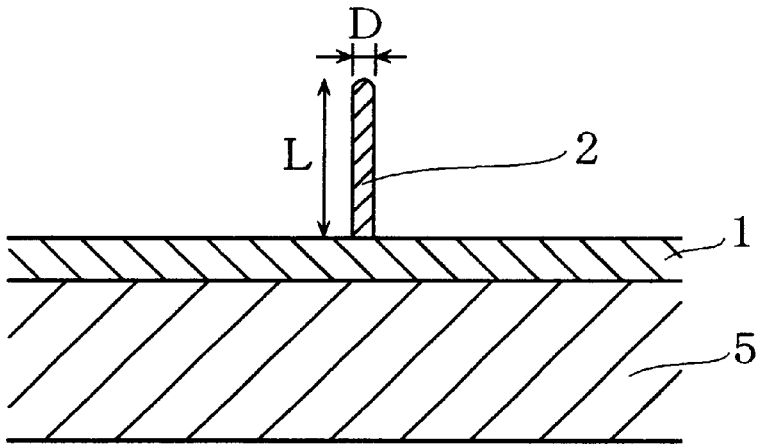
Figure 6C:
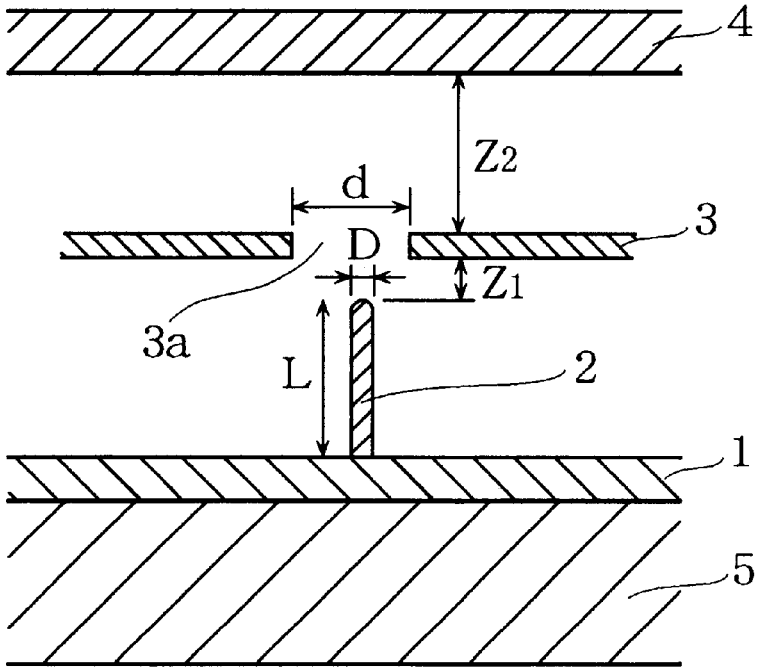

The method of producing an element of this construction is described with reference to FIGS. 6A–6C. First, an aluminum film (a electron conveying member 1) was formed on a substrate 5 comprising soda glass (see FIG. 7(*a*)). Then, an electron-emitting member comprising carbon nanotubes was fixed to the electron conveying member 1 to form a cathode electrode 2 (see FIG. 7(*b*)).

The above-mentioned electron-emitting member is such that a plurality of carbon nanotubes having a length (height) L=2 mm were bonded together for a formation having a maximum width of D=0.2 mm, and the tip was fabricated such that the radius of curvature was r=0.04 mm. This was then fixed to the electron conveying member 1 by applying a mixed substance of 99% isoamyl acetate and 1% nitrocellulose onto the electron conveying member 1 and then disposing the electron-emitting member comprising carbon nanotubes on the mixed substance.

Figure 7A:
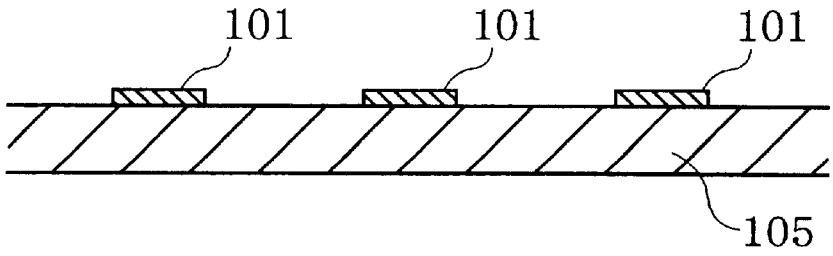
FIGS. 7A–7C are cross sectional schematic views illustrating the production process of an image display device in accordance with Example 8.
Figure 7B:
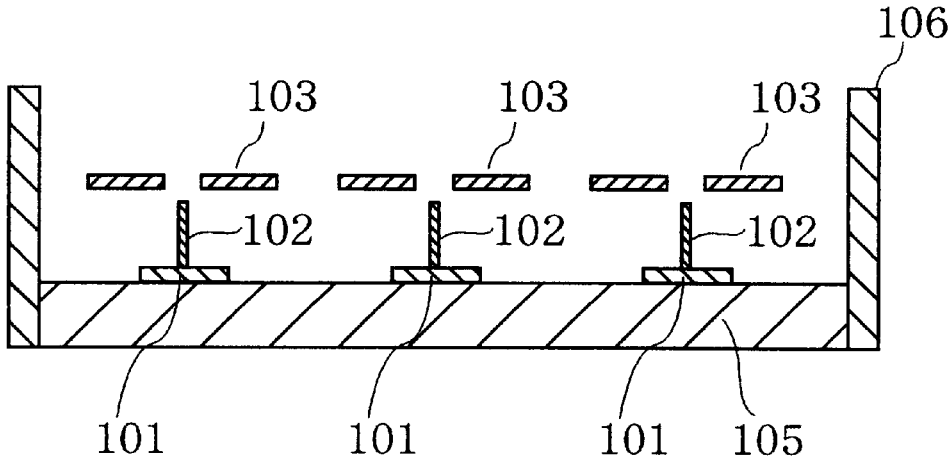
Figure 7C:
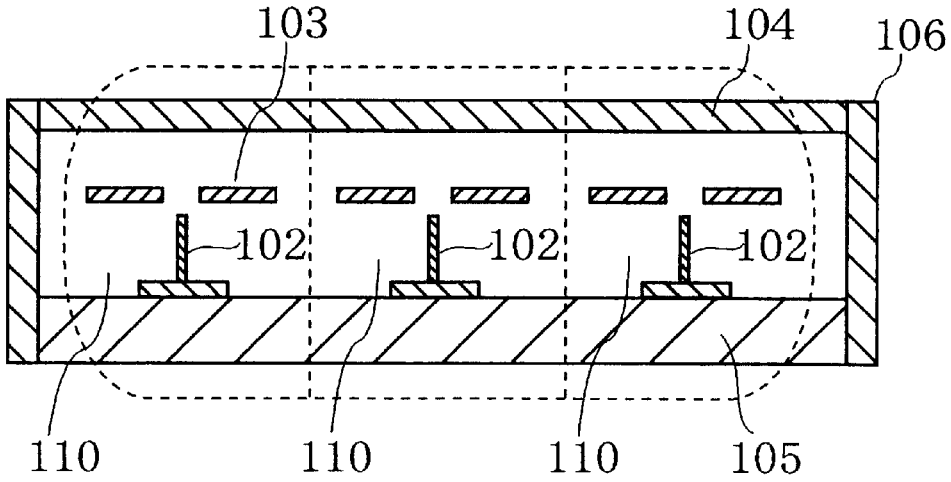
Figure 8A:
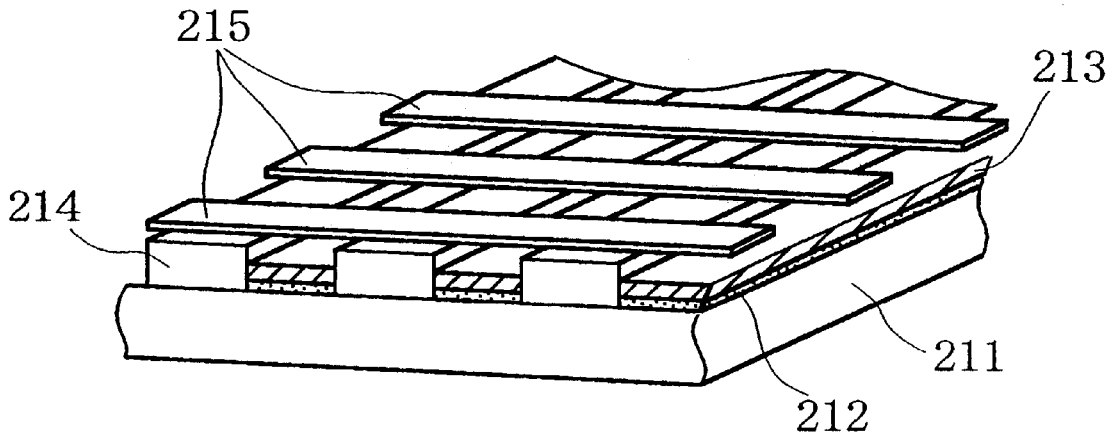
FIG. 8A PRIOR ART
FIGS. 8A–8B show the structure of an electron-emitting element in accordance with prior art.
Figure 8B:
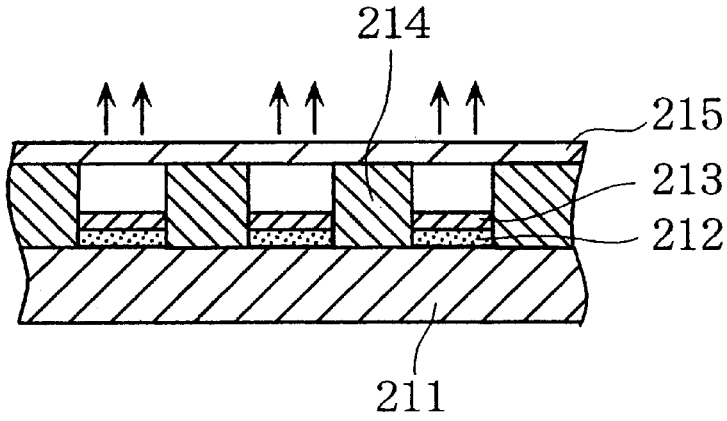
FIG. 8B PRIOR ART

In addition, as shown in FIG. 7(*c*), a grid electrode 3 was disposed at a vertical distance Z1=0.5 mm from the tip of the electron-emitting member (the cathode electrode 2). For the grid electrode 3, a SUS plate (Ni—Cr copper plate) having a plate thickness 0.1 mm and an electron passage opening hole with a hole diameter of d=Φ3 mm was used.

An anode electrode 4 having phosphors applied on the side opposing the cathode electrode was disposed at a vertical distance of Z2=0.5 mm from the grid electrode 3. Finally, an electron-emission controlling section (an electron-emission controlling means) for controlling the voltage applied to each electrode was connected to the electron conveying member 1, the grid electrode 3, and the anode electrode 4 to complete the electron-emitting element of Example 7.

The above-mentioned electron-emission controlling section is constructed such that a potential just under the potential necessary for bringing about the unassisted (when voltage to the grid electrode is 0) field emission of electrons from the cathode electrode 2 is applied to the anode electrode 4 as electron acceleration voltage, and variable voltages (positive voltages) are applied to the grid electrode 3 in the pulling of electrons in a forward direction. In addition, it has a construction (a built in diode) such that electrons do not flow to the grid electrode 3 from the earthed side.

The element of Example 7 constructed in the above-described manner is such that the electric field generated by the voltage applied to the anode electrode 4 emanates to the cathode electrode side from the electron passage opening 3*a*, this electric field combines with the electric field generated by the voltage applied to the grid electrode 3 to form a combined electric field, and the number of electrons emitted from the cathode electrode 2 is controlled by varying the distribution state and intensity of the combined electric field. An element which controls electron emission by using a combined electric field, compared with conventional electron-emitting elements which do not use a combined electric field, can stably control electron emission at a remarkably low operation voltage. Moreover, because this element has a construction such that electrons do not flow to the grid electrode 3 from the earthed side, abnormal discharge does not occur.

EXAMPLE 8

Example 8 relates to an image display device employing an electron-emitting element from those described in Examples 1 to 7. Here, the element of Example 1 was employed.

First, the image display device of Example 8 is generally described with reference to FIG. 7(*c*). In FIG. 7, reference number 101 designates an electron conveying member, reference number 102 designates an electron-emitting member (cathode electrode), reference number 103 designates grid electrodes, reference number 104 designates an anode side substrate also serving as an anode electrode, reference number 105 designates a cathode side substrate, and reference number 106 designates a side wall. In this device, the cathode side substrate 105, the anode side substrate 104, and the side wall 106 are hermetically sealed, and a vacuum is maintained inside the device.

In addition, this device has individual controlling means for individually controlling each electron-emitting element 110 and is constructed such that by utilizing the individual controlling means, upon the applying of voltage to the selected grid electrodes 103, the electron-emitting elements 110 belonging to these grid electrodes 103 emit electrons.

In addition, a phosphor layer is formed on the inner side surface (cathode electrode side surface) of the anode electrode 104. Thus, when electrons emitted from the cathode electrode 102 arrive at the anode electrode 104, the anode electrode side emits light. Also, because this device is constructed such that the emitting of light and the degree of light emitted is controlled in each element by the previously described individual controlling means, as a whole, it is possible to display an arbitrary image.

Next, the production method of this device is described with reference to the FIGS. 7(*a*) to 7(*c*). First, the electron conveying members 101 are formed at a prescribed intervals on the cathode side substrate 105 (see FIG. 7(*a*)), and columnar electron-emitting members (cathode electrodes 102) are fixed on the electron conveying members 101 respectively. Next, the grid electrodes 103 are positioned with respect to the electron-emitting members and disposed accordingly, and the side wall 106 is also disposed (see FIG. 7(*b*)). Subsequently, the anode side substrate 104 overlapping with a portion of an envelope is disposed, and individual controlling means are connected to each electrode to form a hermetically sealed container (see FIG. 7(*c*)). Finally, air in the inside of the container is removed to form an image display device.

Because this device uses the electron-emitting element of Example 1, which is operated on the principle of a combined electric field and which is able to achieve a large electric current at low voltage operation, bright images can be obtained with low power consumption.

INDUSTRIAL APPLICABILITY

The present invention takes on a construction such that a combined electric field formed by combining an electric field that spreads from the anode electrode and an electric field generated by the grid electrode is used, a method of pulling electrons from the cathode electrode is employed, and electron-emitting means is provided, so that by appropriately varying the distribution shape and intensity of the combined electric field, the emission of electrons from the cathode electrode is controlled. The present invention makes possible the realization of an electron-emitting element which can control electron emission accurately and precisely because of the very effective action of the combined electric field on the pulling of electrons. In addition, use of this kind of electron-emitting element enables the realization of a thin and flat display device which makes possible the production of highly accurate images at a low operating voltage. Thus, the present invention is very beneficial to industry.

What is claimed is:

1. An electron-emitting element comprising:

an electron conveying member;

a cathode electrode comprising an electron-emitting member fixed to the electron conveying member;

an anode electrode disposed such that it is spaced from the cathode electrode; and a grid electrode disposed between the cathode electrode and the anode electrode and having an electron passage opening;

wherein the spatial positioning of the three members, the cathode electrode, the anode electrode and the grid electrode, and their respective shapes are constructed such that at least an equipotential surface including a grid electrode surface of an electric field generated between the grid electrode and the anode electrode protrudes toward the cathode electrode side and emanates from the electron passage opening to the cathode electrode side, and the emanated electric field and an electric field generated between the cathode electrode and the grid electrode interact with each other to form a combined electric field; and electron-emission controlling means is provided for varying the intensity of the combined electric field by varying at least the potential of the grid electrode to control the number of electrons emitted from the cathode electrode.

2. An electron-emitting element according to claim 1, wherein the work function of at least an anode electrode side surface of the grid electrode is larger than the work function of the cathode electrode.

3. An electron-emitting element according to claim 1, wherein the grid electrode is earthed by means of an electric circuit through which electrons do not flow from the earthed side.

4. An electron-emitting element according to claim 1, wherein the grid electrode is disposed between the cathode electrode and the anode electrode so that at least the relationship $d \geqq Z1$ is satisfied, where d is the maximum opening length of the electron passage opening and Z1 is the vertical distance from a cathode electrode surface to a surface on the cathode electrode side of the grid electrode.

5. An electron-emitting element according to claim 1, wherein electric field concentration reducing means for reducing an electric field concentration from the anode electrode is performed in the vicinity of the electron passage opening of the grid electrode.

6. An electron-emitting element according to claim 5, wherein the electric field concentration reducing means is such that the work function of a perimeter edge portion on the anode electrode side of the electron passage opening of the grid electrode is larger than the work function of other portions of the grid electrode.

7. An electron-emitting element according to claim 5, wherein the electric field concentration reducing means is such that at least a perimeter edge portion on the anode electrode side of the electron passage opening of the grid electrode is chamfered.

8. An electron-emitting element according to claim 1, wherein the electron-emission controlling means is such that the potential of the anode electrode with respect to the cathode electrode is constant and the strength of the combined electric field is varied by varying the potential of the grid electrode.

9. An electron-emitting element according to claim 1, wherein:

the electron-emission controlling means is such that the potential of the anode electrode with respect to the cathode electrode is a potential at which the field emission of electrons from the cathode electrode in the direction of the anode electrode cannot be brought about by only the potential thereof, and the potential of the grid electrode has the same polarity as that of the anode electrode and by varying the potential of the grid electrode, the strength of the combined electric field is varied.

10. An electron-emitting element according to claim 1, wherein:

the electron-emission controlling means is such that the potential of the anode electrode with respect to the cathode electrode is a potential at which the field emission of electrons from the cathode electrode in the direction of the anode electrode can be brought about by only the potential thereof; and by varying the potential of the grid electrode, the strength of the combined electric field is varied.

11. An electron-emitting element according to claim 10, wherein the potential of the grid electrode has a reverse polarity to that of the anode electrode.

12. An electron-emitting element according to claim 1, wherein:

the cathode electrode comprises an electron-emitting member formed into a columnar shape; and the electron-emitting member is disposed so that an extension line in the tip direction of the electron-emitting member passes through the electron passage opening and is orthogonal to an anode electrode surface.

13. An electron-emitting element according to claim 12, wherein the electron-emitting member has a shape such that the relationship $r \leqq 0.3D$ is satisfied, where r is the radius of curvature of a tip corner portion and D is the maximum width of the column.

14. An electron-emitting element according to claim 12, wherein the grid electrode and the cathode electrode are constructed such that the relationship $d \geqq Z1$ is satisfied, where d is the maximum opening length of the electron passage opening of the grid electrode and Z1 is the vertical distance from a tip of the electron-emitting member.

15. An electron-emitting element according to claim 12, wherein the grid electrode and the cathode electrode are constructed such that the relationship $Z1 \leqq 0.25L$ is satisfied, where L is the height of the electron-emitting member from a surface of the electron conveying member , and Z1 is the vertical distance from a tip of the electron-emitting member to a surface of the grid electrode.

16. An electron-emitting element according to claim 12, wherein:

the electron-emitting member has a shape such that the relationship $r \leqq 0.3D$ is satisfied, where r is the radius of curvature of a tip corner portion thereof and D is the maximum width of the column;

the grid electrode is disposed such that the relationship $Z1 \leqq 0.25L$ is satisfied, where L is the height of the electron-emitting member from a surface of the electron conveying member and Z1 is the vertical distance from a tip portion of the columnar electron-emitting member to a surface of the grid electrode; and the size of the electron passage opening is fixed so that the relationship $d \geqq Z1$ is satisfied, where d is the maximum opening length of the electron passage opening of the grid electrode.

17. An electron-emitting element according to claim 16, wherein the electron-emitting member comprises a carbon-type material.

18. An electron-emitting element according to claim 16, wherein the electron-emitting member comprises graphite having six-carbon rings with dangling $\sigma$ bonds.

19. An electron-emitting element according to claim 16, wherein the electron-emitting member comprises a crystal whisker substance.

20. An electron-emitting element according to claim 16, wherein the electron-emitting member comprises carbon fiber.

21. An electron-emitting element according to claim 16, wherein the electron-emitting member comprises carbon nanotubes.

22. An electron emitting element according to claim 1, wherein:

the cathode electrode further comprises at least one other electron-emitting member fixed to a surface of the electron conveying member, the electron-emitting members having a columnar shape; and the electron emitting element is constructed such that, between the columnar electron-emitting members and the grid electrode, the relationships $P \geqq 0.5L$ and $Z1 \leqq 0.25L$ are satisfied, where P is the interval between each of the electron-emitting members, L is the height of the electron-emitting members from the surface of the electron conveying member, and Z1 is the vertical distance from the tip of the electron-emitting member having the highest vertical height to a surface of the grid electrode.

23. An electron-emitting element according to claim 22, wherein the work function of at least an anode electrode side surface of the grid electrode is larger than the work function of the cathode electrode.

24. An electron-emitting element according to claim 23, wherein the maximum length d of the electron passage opening of the grid electrode is formed such that the relationship $d \geqq Z1$ is satisfied, where d is the maximum opening length of the electron passage opening of the grid electrode and Z1 is the vertical distance from the tip of the electron-emitting member having a vertical height L to the surface of the grid electrode.

25. An electron-emitting element according to claim 24, wherein electric field concentration reducing means for reducing an electric field concentration from the anode electrode is performed in the electron passage opening of the grid electrode.

26. An electron-emitting element according to claim 25, wherein the electric field concentration reducing means is such that the work function of the perimeter edge portion of the electron passage opening of the grid electrode on the anode electrode side is larger than the work function of other portions of the grid electrode.

27. An electron-emitting element according to claim 25, wherein the electric field concentration reducing means is such that chamfering is performed on at least the perimeter edge portion of the electron passage opening of the grid electrode on the anode electrode side.

28. An electron-emitting element according to claim 27, wherein the grid electrode is earthed by means of an electric circuit through which electrons do not flow from the earthed side.

29. An electron-emitting element according to claim 28, wherein the electron-emitting members comprise a carbon-type material.

30. An electron-emitting element according to claim 28, wherein the electron-emitting members comprise graphite having six-carbon rings with dangling σ bonds.

31. An electron-emitting element according to claim 28, wherein the electron-emitting members comprise a crystal whisker substance.

32. An electron-emitting element according to claim 28, wherein the electron-emitting members comprise carbon fiber.

33. An electron-emitting element according to claim 28, wherein the electron-emitting members comprise carbon nanotubes.

34. An image display device comprising a plurality of electron-emitting elements, a circuit which is connected to each of the electron-emitting elements and which transmits electric signals to each of the electron-emitting elements for electron emission, and an image formation section for forming an image by means of electrons emitted from the electron-emitting elements, wherein the electron-emitting elements are any of the electron-emitting elements of claim 1.

35. An electron emitting-element comprising:

an electron conveying member;

a cathode electrode comprising an electron-emitting member fixed to the electron conveying member;

an anode electrode disposed such that it is spaced from the cathode electrode; and a grid electrode disposed between the cathode electrode and the anode electrode, earthed by means of an electric circuit through which electrons do not flow from the earthed side, and having an electron passage opening;

wherein the spatial positioning of the three members, the cathode electrode, the anode electrode and the grid electrode, and their respective shapes are constructed such that an electric field existing between the grid electrode and the anode electrode emanates from the electron passage opening to the cathode electrode side, and the emanated electric field and an electric field existing between the cathode electrode and the grid electrode interact with each other to form a combined electric field; and electron-emission controlling means is provided for varying the intensity of the combined electric field by varying the potential of at least one of the cathode electrode, the anode electrode, and the grid electrode to control the number of electrons emitted from the cathode electrode.

36. An electron-emitting element comprising:

an electron conveying member;

a cathode electrode comprising an electron-emitting member fixed to the electron conveying member;

an anode electrode disposed such that it is spaced from the cathode electrode; and a grid electrode disposed between the cathode electrode and the anode electrode and having an electron passage opening;

wherein the spatial positioning of the three members, the cathode electrode, the anode electrode and the grid electrode, and then respective shapes are constructed such that an electric field existing between the grid electrode and the anode electrode emanates from the electron passage opening to the cathode electrode side, and the emanated electric field and an electric field existing between the cathode electrode and the grid electrode interact with each other to form a combined electric field, and the electron emission controlling means is such that the potential of the anode electrode with respect to the cathode electrode is a potential at which the field emission of electrons from the cathode electrode in the direction of the anode electrode cannot be brought about by only the potential thereof, the potential of the grid electrode has the same polarity as that of the anode electrode, and by varying the potential of the grid electrode, the strength of the combined electric field is varied and the number of electrons emitted from the cathode electrode is controlled.

37. An image display device comprising a plurality of electron-emitting elements, a circuit which is connected to each of the electron-emitting elements and which transmits electric signals to each of the electron-emitting elements for electron emission, and an image formation section for forming an image by means of electrons emitted from the electron-emitting elements, wherein the electron-emitting elements are either the electron-emitting elements of claim 35.

* * * * *